US009080247B2

(12) United States Patent
Dewaki et al.

(10) Patent No.: US 9,080,247 B2
(45) Date of Patent: Jul. 14, 2015

(54) TIN-CONTAINING ALLOY PLATING BATH, ELECTROPLATING METHOD USING SAME, AND SUBSTRATE WITH THE ELECTROPLATING DEPOSITED THEREON

(75) Inventors: Shinji Dewaki, Nagoya (JP); Teru Matsuura, Tokyo (JP); Kenji Dewaki, Nagoya (JP); Yukari Dewaki, legal representative, Nagoya (JP)

(73) Assignees: SHINJI DEWAKI, Nagoya (JP); M-TECH JAPAN CO., LTD., Tokyo (JP); YUKARI DEWAKI, Nagoya (JP)

( * ) Notice: Subject to any disclaimer, the term of this patent is extended or adjusted under 35 U.S.C. 154(b) by 656 days.

(21) Appl. No.: 13/386,805

(22) PCT Filed: Jul. 31, 2009

(86) PCT No.: PCT/JP2009/063691

§ 371 (c)(1),
(2), (4) Date: Mar. 19, 2012

(87) PCT Pub. No.: WO2011/013252

PCT Pub. Date: Feb. 3, 2011

(65) Prior Publication Data

US 2012/0208044 A1 Aug. 16, 2012

(51) Int. Cl.

| | |
|---|---|
| ***B32B 15/01*** | (2006.01) |
| ***C25D 3/60*** | (2006.01) |
| ***C25D 3/56*** | (2006.01) |

(52) U.S. Cl.

CPC .. *C25D 3/60* (2013.01); *C25D 3/56* (2013.01); *Y10T 428/12715* (2015.01); *Y10T 428/12722* (2015.01)

(58) Field of Classification Search

None

See application file for complete search history.

(56) References Cited

U.S. PATENT DOCUMENTS

| | | | | |
|---|---|---|---|---|
| 4,478,691 | A | 10/1984 | Abys | |
| 6,361,742 | B2 * | 3/2002 | Takeda et al. | 420/557 |
| 7,214,409 | B1 | 5/2007 | Kasule | |
| 8,653,375 | B2 * | 2/2014 | Osenbach | 174/126.2 |
| 2003/0159938 | A1 * | 8/2003 | Hradil | 205/118 |
| 2004/0020567 | A1 | 2/2004 | Baldwin | |
| 2009/0046566 | A1 | 2/2009 | Fujii et al. | |
| 2010/0000873 | A1 | 1/2010 | Imanari et al. | |
| 2011/0293961 | A1 | 12/2011 | Dewaki et al. | |

FOREIGN PATENT DOCUMENTS

| | | | |
|---|---|---|---|
| EP | 1 024 211 | A2 | 8/2000 |
| EP | 1 617 427 | A2 | 1/2006 |
| EP | 1 889 932 | A1 | 2/2008 |
| JP | A-62-218595 | | 9/1987 |
| JP | A-62-218596 | | 9/1987 |
| JP | A-5-287542 | | 11/1993 |
| JP | A-08-176883 | | 7/1996 |
| JP | A-2000-76948 | | 3/2000 |
| JP | A-2002-167676 | | 6/2002 |
| JP | A-2002-226927 | | 8/2002 |
| JP | A-2004-113950 | | 4/2004 |
| JP | A-2005-5716 | | 1/2005 |
| JP | A-2007-111898 | | 5/2007 |
| JP | A-2008-51840 | | 3/2008 |
| JP | A-2008-088477 | | 4/2008 |
| JP | A-2008-194689 | | 8/2008 |
| JP | A-2008-280559 | | 11/2008 |
| TW | 200728479 | A | 8/2007 |
| TW | 201006966 | A1 | 2/2010 |

OTHER PUBLICATIONS

International Search Report issued in International Application No. PCT/JP2009/063691 dated Nov. 10, 2009 (with translation).

Notification of the First Office Action dated Dec. 2, 2013 from Chinese Patent Application No. 200980160631.7 (with English-language translation).

Jan. 8, 2013 Office Action issued in Taiwanese Patent Application No. 99125437 (with translation).

Jan. 4, 2013 Search Report issued in Taiwanese Patent Application No. 99125437 (with translation).

Office Action dated Feb. 4, 2014 from U.S. Appl. No. 13/147,901.

Yasui et al.; "A Sulfuration Gas Test for Chip Components With Solder Plating on Silver Termination;" *Journal of Reliability Engineering Association of Japan*; 2002; pp. 761-766; vol. 25, No. 8 (with Abstract).

International Search Report dated May 19, 2009 from International Application No. PCT/JP2009/052088.

Gschneldner, Jr., et al.; "The Ag—Gd (Silver—Gadolinium) System;" *Bulletin of Alloy Phase Diagrams*; 1985; pp. 138-140; vol. 6, No. 2.

(Continued)

*Primary Examiner* — Mark Ruthkosky

*Assistant Examiner* — Daniel J Schleis

(74) *Attorney, Agent, or Firm* — Oliff PLC

(57) ABSTRACT

Provided are a tin-containing alloy plating bath being capable of manufacturing a tin-containing alloy plated product suitable for electric and electronic members with excellent anti-oxidation performance, and an electroplating method using the bath. Specifically the bath is a plating bath to deposit a tin-containing alloy on the surface of a substrate, which plating bath contains: (a) a tin compound containing 99.9% by mass to 46% by mass of tin based on entire metal mass in the plating bath; (b) a gadolinium compound containing 0.1% by mass to 54% by mass of gadolinium based on entire metal mass in the plating bath; (c) at least one complexing agent; and (d) a solvent, and the electroplating method uses the tin-containing alloy bath, thus can manufacture a tin-containing alloy plated product having excellent anti-oxidation performance.

4 Claims, No Drawings

(56) References Cited

OTHER PUBLICATIONS

Taiwanese Office Action dated Dec. 17, 2012 from Taiwanese Patent Application No. 99103335 (with partial English-language translation).

Extended European Search Report dated Jan. 9, 2013 from European Patent Application No. 09 83 9659.1.

Hodge et al.; "Stresses in Thin Film Metallization;" *IEEE Transactions on Components, Packaging, and Manufacturing Technology—Part A*; Jun. 1997; pp. 241-250; vol. 20, No. 2.

Hwang et al.; "Evolutions of Surface Morphologies in Sputtered and Electroplated Cu Films During Thermal Cycling;" *Material Science Forum*; 2002; pp. 1651-1656; vols. 408-412.

Hoshi et al.; Properties of Electroplated Aluminum Thin Films; *Hitachi Kinzoku Gihou*; 2011; pp. 20-27; vol. 27 (with partial English-language translation).

Official Notice of Rejection dated Aug. 27, 2013 from Japanese Patent Application No. 2010-549284 (with English-language translation).

U.S. Office Action dated Jun. 12, 2013 from U.S. Appl. No. 13/147,901.

* cited by examiner

TIN-CONTAINING ALLOY PLATING BATH, ELECTROPLATING METHOD USING SAME, AND SUBSTRATE WITH THE ELECTROPLATING DEPOSITED THEREON

TECHNICAL FIELD

The present invention relates to a tin-containing alloy electroplating bath which can manufacture a tin-containing alloy plated product suitable for electric and electronic members, an electroplating method using the same, and a substrate on which the electroplating is deposited.

BACKGROUND ART

Copper alloys are uses as the base materials of electric and electronic components such as connectors and terminals applied generally to automobiles, household electric appliances, office automation equipment, and the like. These base materials are treated by plating in order to improve the functions such as rust-prevention, improved corrosion resistance, and improved electric characteristics. Specifically a tin-lead alloy plating containing 5 to 40% by weight of lead has been widely used owing to excellent anti-whisker performance, solder wettability, adhesion, bendability, heat-resistance, and the like, (for example, refer to Japanese Patent Laid-Open No. 8-176883 (PTL 1)).

In recent years, however, the influence of lead on the environment drew attention, thus there has been rapidly progressing the switching to a plating not containing lead, or to a lead-free plating, as a measure for environmental conservation.

On the other hand, the lead-free tin-containing alloy plating likely generates whiskers on the surface of plating. Consequently, accompanied with the densification of electronic components in recent years, the tin-containing alloy plated products raise serious problems such as the generation of whiskers, the contact resistance failure caused by surface oxidation, and the electric short circuit.

Responding to these problems, persons skilled in the art studied the anti-whisker measures on the tin-containing alloy plated products. Japanese Patent Laid-Open No. 2008-88477 proposed a method forming specific base layer and intermediate layer, applying tin plating, and further conducting reflow treatment, (refer to PTL 2). Japanese Patent Laid-Open No. 2008-194689 proposed a method forming two kinds of tin plating films each having different crystal types, thus suppressing the generation of whiskers, (refer to PTL 3). Furthermore, Japanese Patent Laid-Open No. 2008-280559 suppresses the generation of whiskers by treating connectors and the like, on which lead-free tin-containing alloy plating is applied, with ultrasonic waves, (refer to PTL 4). These methods have, however, complex process compared with the cases using tin-lead alloy plating.

CITATION LIST

Patent Literature

PTL 1: Japanese Patent Laid-Open No. H08-176883
PTL 2: Japanese Patent Laid-Open No. 2008-88477
PTL 3: Japanese Patent Laid-Open No. 2008-194689
PTL 4: Japanese Patent Laid-Open No. 2008-280559

SUMMARY OF INVENTION

Technical Problem

The present invention has been made in view of the above circumstances. An object of the present invention is to provide a tin-containing alloy electroplating bath which can prevent the surface oxidation of the manufactured tin-containing alloy plated products, thus suppresses the generation of whiskers, to provide an electroplating method using the same, and to provide a substrate on which the electroplating is deposited.

Solution to Problem

The present invention provides a tin-containing alloy electroplating bath which can manufacture tin-containing alloy plated products suitable for electric and electronic members and having excellent antioxidation performance, an electroplating method using the same, and a substrate on which the electroplating is deposited.

Specifically the present invention can manufacture a tin-containing alloy plated product having excellent antioxidation performance by applying a plating bath to deposit a tin-containing alloy on the surface of a substrate, the bath containing: (a) a tin compound containing 99.9% by mass to 46% by mass of tin based on entire metal mass in the plating bath; (b) a gadolinium compound containing 0.1% by mass to 54% by mass of gadolinium based on entire metal mass in the plating bath; (c) at least one complexing agent; and (d) a solvent, and by applying an electroplating method using the electroplating bath.

Advantageous Effects of Invention

The electroplating method using the tin-containing alloy plating bath according to the present invention can provide the tin-containing alloy plated product which prevents surface oxidation and suppresses generation of whiskers. Furthermore, the obtained tin-containing alloy plated product can suppress discoloration of the plating surface while maintaining the wettability similar to that of tin-lead alloy plating, thus providing a surface hardness of 20 to 165 of Vickers hardness.

DESCRIPTION OF EMBODIMENTS

The modes for carrying out the invention are described in the following. The embodiments given below are simply examples of the present invention, and a person skilled in the art can modify the design adequately.

(Plating Bath)

The plating bath according to the present invention contains: (a) a tin compound containing 99.9% by mass to 46% by mass of tin based on entire metal mass in the plating bath; (b) a gadolinium compound containing 0.1% by mass to 54% by mass of gadolinium based on entire metal mass in the plating bath; (c) at least one complexing agent; and (d) a solvent.

a. Tin Compound

The tin compound according to the present invention is only required to be the one which is dissolved in a solvent as single compound or together with a complexing agent described later, thus can provide tin ion. Although the present invention does not limit to these kinds of compounds, there can be used tin salts such as tin chloride, tin bromide, tin sulfate, tin sulfite, tin carbonate, organic tin sulfonate, tin sulfosuccinate, tin nitrate, tin citrate, tin tartrate, tin gluconate, tin oxalate, and tin oxide, and arbitrary soluble salts containing a mixture of them. As of these, a salt with organic tin sulfonate is preferred.

The tin ion provided from the tin compound is contained in the plating bath of the present invention at a quantity of 99.9% by mass to 46% by mass based on entire metal mass in the plating bath; preferably 99.7% by mass to 50% by mass, more preferably from 99.7% by mass to 60% by mass, and most preferably from 99.7% by mass to 70% by mass.

The concentration of entire metal ion in the plating bath is in a range from 0.01 g/L to 200 g/L, and preferably from 0.5 g/L to 100.0 g/L. Generally the tin ion exists in the plating bath in a range from 20 g/L to 200 g/L, and preferably from 25 g/L to 80 g/L.

b. Gadolinium Compound

The gadolinium compound according to the present invention is arbitrary compound if only the compound can be dissolved in a solvent solely or together with a complexing agent described below, thus providing gadolinium ions. In the present invention, applicable gadolinium compounds include gadolinium salt such as gadolinium nitrate, gadolinium oxide, gadolinium sulfate, gadolinium chloride, and gadolinium phosphate, and a mixture thereof, though not limited to them. Among these, gadolinium oxide is preferred.

The gadolinium ions provided from a gadolinium compound exist in the plating bath of the present invention by amounts from 0.1% to 54% by mass on the basis of the total metal mass in the plating bath. Preferably these gadolinium ions may exist by amounts from 0.3% to 50% by mass, more preferably from 0.3% to 40% by mass, and most preferably from 0.3% to 30% by mass. If the amount of gadolinium ions is smaller than 0.1% by mass, the whisker generation from the obtained silver-containing alloy plated product cannot fully be suppressed. On the other hand, if the amount of gadolinium ions is 54% by mass or larger to the total mass of the metal, the electric conductivity deteriorates. Generally the gadolinium ions exist in the plating bath by amounts from 0.01 to 5.0 g/L, preferably from 0.1 to 5.0 g/L.

c. Complexing Agent

The complexing agent is a compound to stabilize ion by coordinating to tin ion and/or gadolinium ion provided by the tin compound and/or the gadolinium compound, respectively. According to the present invention, the complexing agent can have two or more metal-coordinated sites.

Applicable complexing agents in the present invention include: amino acid having 2 to 10 carbon atoms; polycarboxylic acid such as oxalic acid, adipic acid, succinic acid, malonic acid, and maleic acid; aminoacetic acid such as nitrilotriacetate; alkylene polyamine polyacetate such as ethylenediamine tetraacetate (EDTA), diethylenetriamine pentaacetate (DTPA), N-(2-hydroxyethyl)ethylenediamine triacetate, 1,3-diamino-2-propanol-N,N,N',N'-tetraacetate, bis-(hydroxyphenyl)-ethylenediaminediacetate, diaminocyclohexane tetraacetate, and ethyleneglycol-bis-((β-aminoethylether)-N,N'-tetraacetate); polyamine such as N,N,N',N'-tetrakis-(2-hydroxypropyl)ethylene diamine, ethylenediamine, 2,2',2"-triaminotriethylamine, trimethylenetetramine, diethylenetriamine, and tetrakis(aminoethyl)ethylenediamine; citrate; tartrate; N,N-di-(2-hydroxyethyl) glycine; gluconate; lactate; crown ether; cryptand; polyhydroxyl group compound such as 2,2',2"-nitrilotriethanol; hetero aromatic compound such as 2,2'-bipyridin, 1,10-phenanthroline, and 8-hydroxyquinoline; thio-containing ligand such as thioglycol acid with diethyldithiocarbamate; and amino alcohol such as ethanolamine, diethanolamine, and triethanolamine, though not limited to them. Above complex agents may be used in combination of two or more of them.

The complexing agent according to the present invention can be used in various concentrations. For example, there can be the stoichiometric amount to the entire quantity of tin ion and/or gadolinium ion existing in the plating bath, or an excess quantity from stoichiometric amount so as to complex entire tin ion and/or gadolinium ion. The term "stoichiometric" signifies equi-mole used herein.

The complexing agent may exist in the plating bath at a concentration ranging from 0.1 to 250 g/L. Preferably the complexing agent exists in the plating bath at an amount from 2 to 220 g/L, and more preferably from 50 to 150 g/L.

d. Solvent

The solvent of the plating bath according to the present invention is only required to be the one which can dissolve the tin compound, the gadolinium compound, and the complexing agent. The solvent can be water and a non-aqueous solvent such as acetonitril, alcohol, glycol, toluene, and dimethylformamide. A preferable solvent is the one from which other metal ions was removed by ion resins, and the like. The most preferable one is water treated by removal of metal ions.

The plating bath of the present invention normally has a pH value ranging from 1 to 14, preferably not more than 7, and more preferably not more than 4. The pH of the plating bath may be maintained at a desired level by adding a buffer thereto. Any compatible acid or base can be used as the buffer, and organic or inorganic compound thereof can be applied. The term "compatible acid or base" means that no precipitation of silver ions and/or complexing agent is generated from the solvent when that kind of acid or base is used at an amount sufficient to buffer the pH. Examples of the buffer are alkali metal hydroxide such as sodium hydroxide and potassium hydroxide, carbonate, citric acid, tartaric acid, nitric acid, acetic acid, and phosphoric acid, though not limited to them.

e. Additive

The plating bath of the present invention can optionally contain known additives such as surfactant, stabilizer, gloss agent, semi-gloss agent, antioxidant, and pH adjustor.

Above surfactant includes: nonionic surfactant prepared by addition condensation of $C_1$-$C_{20}$ alkanol, phenol, naphthol, bisphenols, $C_1$-$C_{25}$ alkylphenol, arylalkylphenol, $C_1$-$C_{25}$ alkylnaphtol, $C_1$-$C_{25}$ alkoxylated phosphoric acid (salt), sorbitan ester, styrenated phenols, polyalkylene glycol, $C_1$-$C_{22}$ aliphatic amine, $C_1$-$C_{22}$ aliphatic amide, and the like with 2 to 300 moles of ethylene oxide (EO) and/or propylene oxide (PO); and various surfactants of cationic, anionic, or amphoteric.

Above-given stabilizer is added aiming to stabilize the liquid or to prevent decomposition of the liquid, and specifically effective ones are known stabilizers such as cyan compound, sulfur-containing compound such as thioureas, sulfite, and acetylcysteine, and oxycarbonates such as citric acid. Furthermore, above-described complexing agents are also useful as the stabilizer.

Above-given gloss agents include: various aldehydes such as m-chlorobenzaldehyde, p-nitrobenzaldehyde, p-hydroxybenzaldehyde, 1-naphtoaldehyde, salicylaldehyde, paraldehyde, acrolein, chlotonaldehyde, glutaraldehyde, and vanillin; ketones such as benzalacetone and acetophenone; unsaturated carboxylic acid such as acrylic acid, methacrylic acid, and crotonic acid; triazine; imidazole; indole; quinoline; 2-vinylpyridine; and aniline.

Above-given semi-gloss agents include: thioureas; N-(3-hydroxybutylidene)-p-sulfanyl acid; N-butylidenesulfanyl acid; N-cinnamoylidene sulfanilic acid; 2,4-diamino-6-(2'-methylimidazolyl(1'))ethyl-1,3,5-triazine 2,4-diamino-6-(2'-ethyl-4-methylimdazolyl(1'))ethyl-1,3,5-triazine; 2,4-diamino-6-(2'-undecylimidazolyl(1'))ethyl-1,3,5-triazine; phenyl salcilate, and benzothiazoles such as benzothiazole, 2-methylbenzothiazole, 2-(methylmercapto)benzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, 2-mercaptobenzothiazole, 6-nitro-2-mercaptobenzothiazole, 5-hydroxy-2-methylbenzothiazole, and 2-benzothiazolethioacetate. Above-given antioxidants include: ascorbic acid or salt thereof; hydroquinone; catechol; resorcin; phloroglucin; cresol sulfonate and salt thereof; phenol sulfonate and salt thereof; and naphtol sulfonate and salt thereof.

Above-given pH adjustors include: various acids such as hydrochloric acid and sulfuric acid; and various bases such as ammonium hydroxide and sodium hydroxide.

(Electroplating Method)

The present invention provides an electroplating method which contains the steps of: immersing the substrate in a plating bath; and applying an electric field to the substrate, and the plating bath contains: (a) a tin compound containing 99.9% by mass to 46% by mass of tin based on entire metal mass in the plating bath; (b) a gadolinium compound containing 0.1% by mass to 54% by mass of gadolinium based on entire metal mass in the plating bath; (c) at least one complexing agent; and (d) a solvent. The method of electroplating method according to the present invention can use methods such as barrel plating, rack plating, high speed continuous plating, reckless plating, and the like, being widely known by the persons skilled in the art.

a. Substrate

According to the present invention, the substrate which allows the tin-containing alloy to deposit on the surface thereof is conductive one, and the substrate is used as the cathode in the electroplating process. Although the conductive materials used as the substrate are not limited to those ones, they include iron, nickel, copper, chromium, tin, zinc, and their alloys; preferably stainless steel, 42 alloy, phosphor bronze, nickel, brass, and the like. The substrate can be subjected to surface treatment to improve the adhesion of plating.

b. Electrolysis Condition

According to the electroplating method of the present invention, the substrate to allow the tin-containing alloy to deposit (plating) on the surface is used as the cathode. A soluble anode or preferably insoluble anode is used as the second electrode. According to the present invention, pulse plating or direct current plating, or a combination of them can be used.

Depending on the substrate being plated, person skilled in the art can adequately change the design current density and the potential on the surface of electrode in the electroplating process. Generally the current density of anode and of cathode varies in a range from 0.5 A/cm$^2$ to 5 A/cm$^2$. The temperature of the plating bath is kept in a range from 25° C. to 35° C. during the electroplating process. The electroplating process is sustained for a sufficient time to allow the formed deposit to reach a desired thickness. The method of the present invention can form the tin-containing alloy film on the surface of the substrate by a thickness ranging from 0.01 μm to 50 μm.

(Substrate with the Deposited Electroplating)

The present invention provides a substrate with the deposited electroplating on the surface thereof containing: (1) tin by a quantity ranging from 99.9% by mass to 46% by mass based on entire metal mass; and (2) gadolinium by a quantity ranging from 0.1% by mass to 54% by mass based on entire metal mass.

The tin-containing alloy plating deposited on the surface of the substrate can suppress the surface oxidation and can hinder the generation of whiskers. Furthermore, the tin-containing alloy plating has a hardness ranging from 20 to 165 of Vickers hardness.

Although the reason that the tin-containing alloy plating deposited on the surface of the substrate according to the present invention has above-described property of excellent anti-oxidation performance is not strictly analyzed by theory, the reason is presumably that the addition of gadolinium allows forming a tin-containing alloy which has a dense crystal structure.

EXAMPLES

The present invention and the effect of the invention are described below referring to Examples and Comparative Examples. These Examples, however, do not limit the scope of the present invention.

(Heat Resistance Test)

An electrolytically plated substrate was heated to 280° C. for 3 minutes, and the changes appeared on the plating surface were observed. In addition, the heat-treated plating surface was evaluated by the cross-cut method (1 mm of spacing).

(Contact Resistance)

The electrolytically plated substrate was clamped by a pair of terminal electrodes. The contact area between the terminal electrode and the substrate was set to 10 cm$^2$, and the terminal electrode was pressed against the substrate applying 1000 N of force. In that state, a 5.00 A of current was applied between the terminal electrodes, and the potential difference between one terminal electrode and the substrate was determined. Using thus obtained potential difference, the contact resistance was determined.

(Method for Determining the Surface Vickers Hardness)

Using a surface hardness gauge (Model DMH-2, manufactured by Matsuzawa Co., Ltd.), the Vickers hardness was determined in an environment at normal temperature under a loading condition of 0.245 N (25 gF) for 15 seconds.

(Salt Spray Test)

Based on JIS H8502, the electroplated substrate was subjected to neutral salt spray test (5%-NaCl aqueous solution). The condition of plated surface (presence/absence of corrosion) was observed after 0.5 hours, 2 hours, and 8 hours.

(Whisker Test)

Based on the Japan Electronics and Information Technology Industries Association (JEITA) Standard ET-7410, the generation of whiskers was observed under high temperature and high humidity condition.

The electroplated substrate was held at 55° C.±3° C. and 85% of RH for 2000 hours. After that, the presence/absence of whisker on the surface of the specimen was observed using a scanning electron microscope (SEM) over a surface area of 0.2 mm×0.4 mm. When no whisker was found, the mark "Not generated" was given. When the length of generated whisker is 1 μm to 10 μm, the mark "Slightly generated" was given. When the length thereof is 10 μm or longer, the mark "Generated" was given.

(Solder Wettability Test)

In accordance with JIS Z3196, an electrolytically plated substrate was subjected to solder wettability test by the wetting balance method. The evaluation was given using the solder bath of: tin-lead eutectic solder (tin: lead=60%:40%) as lead-based solder, and tin-silver-copper solder (M705, tin: silver:copper=96.5%:3%:0.5%, manufactured by Senju Metal Industry Co., Ltd.) as lead-free solder, respectively.

Example 1

A plating bath containing the following-listed components at concentrations given in Table 1 was prepared. Thus prepared plating bath showed strong acidity.

TABLE 1

| | |
|---|---|
| Tin oxide | 35 g/L |
| Isopropanol sulfonate | 150 g/L |
| Diethanolamine | 60 g/L |
| Gloss agent | 5 g/L |
| L-Ascorbic acid | 1 g/L |
| Gadolinium oxide | 0.4 g/L |

Electroplating was applied to an iron-based substrate and a copper-based substrate in the above plating bath, respectively. That is, the substrate was immersed in the plating bath at a temperature ranging from 25° C. to 30° C., and a current ranging from 0.5 to 5.0 A/dm$^2$ of current density was applied to the substrate using the substrate as the cathode for 1 to 2 minutes, thus obtained a plating film with 2.0 μm of thickness. The content of gadolinium in thus obtained plating film was 0.10% by mass based on the entire mass of the plating film.

The obtained plating film was tested in terms of heat resistance, contact resistance, Vickers hardness, and salt water durability. The result is given in Table 5.

Example 2

A plating bath containing the following-listed components at concentrations given in Table 2 was prepared. Thus prepared plating bath showed strong acidity.

TABLE 2

| | |
|---|---|
| Tin oxide | 35 g/L |
| Isopropanol sulfonate | 120 g/L |
| Diethanolamine | 50 g/L |
| Gloss agent | 5 g/L |
| L-Ascorbic acid | 1 g/L |
| Gadolinium oxide | 0.6 g/L |

Electroplating was applied to an iron-based substrate and a copper-based substrate in the above plating bath, respectively. That is, the substrate was immersed in the plating bath at a temperature ranging from 25° C. to 30° C., and a current ranging from 0.5 to 5.0 A/dm$^2$ of current density was applied to the substrate using the substrate as the cathode for 1 to 2 minutes, thus obtained a plating film with 2.0 μm of thickness. The content of gadolinium in thus obtained plating film was 0.30% by mass based on the entire mass of the plating film.

The obtained plating film was tested in terms of heat resistance, contact resistance, Vickers hardness, and salt water durability. The result is given in Table 5.

Example 3

A plating bath containing the following-listed components at concentrations given in Table 3 was prepared. Thus prepared plating bath showed strong acidity.

TABLE 3

| | |
|---|---|
| Tin oxide | 35 g/L |
| Isopropanol sulfonate | 120 g/L |
| Diethanolamine | 50 g/L |
| Gloss agent | 5 g/L |
| L-Ascorbic acid | 1 g/L |
| Gadolinium oxide | 9.5 g/L |

Electroplating was applied to an iron-based substrate and a copper-based substrate in the above plating bath, respectively. That is, the substrate was immersed in the plating bath at a temperature ranging from 25° C. to 30° C., and a current ranging from 0.5 to 5.0 A/dm$^2$ of current density was applied to the substrate using the substrate as the cathode for 1 to 2 minutes, thus obtained a plating film with 2.0 μm of thickness. The content of gadolinium in thus obtained plating film was 8.00% by mass based on the entire mass of the plating film.

The obtained plating film was tested in terms of heat resistance, contact resistance, Vickers hardness, and salt water durability. The result is given in Table 5.

Example 4

A plating bath containing the following-listed components at the respective concentrations given in Table 4 was prepared. Thus prepared plating bath showed strong acidity.

TABLE 4

| | |
|---|---|
| Tin oxide | 35 g/L |
| Isopropanol sulfonate | 120 g/L |
| Diethanolamine | 50 g/L |
| Gloss agent | 5 g/L |
| L-Ascorbic acid | 1 g/L |
| Gadolinium oxide | 29 g/L |

Electroplating was applied to an iron-based substrate and a copper-based substrate in the above plating bath, respectively. That is, the substrate was immersed in the plating bath at a temperature ranging from 25° C. to 30° C., and a current ranging from 0.5 to 5.0 A/dm$^2$ of current density was applied to the substrate using the substrate as the cathode for 1 to 2 minutes, thus obtained a plating film with 2.0 μm of thickness. The content of gadolinium in thus obtained plating film was 54.00% by mass based on the entire mass of the plating film.

The obtained plating film was tested in terms of heat resistance, contact resistance, Vickers hardness, and salt water durability. The result is given in Table 5.

For the respective plating films obtained from the respective plating baths given in Examples 1 to 4 and Comparative Examples 1 to 5, there was conducted tests of heat resistance, contact resistance, Vickers hardness, and salt water durability. The result is given in Table 5.

TABLE 5

| Bath | Substrate | Thickness of plating (μm) | Heat-resistance test 280° C., 3 min | Cross-cut after heat-resistance test | Contact resistance (mΩ) | Surface hardness (HV) | Salt spray test 1 H | 24 H | 168 H | whiskers |
|---|---|---|---|---|---|---|---|---|---|---|
| Example 1 (Sn + 0.1% Gd) | Iron-based substrate | 2.0 | ◎ | ○ | 0.205 | 36.9 | ○ | ○ | ○ | Slightly generated |
| | Copper-based substrate | 2.0 | ◎ | ○ | 0.195 | 36.9 | ○ | ○ | ○ | Generated |

TABLE 5-continued

| Bath | Substrate | Thickness of plating (μm) | Heat-resistance test 280° C., 3 min | Cross-cut after heat-resistance test | Contact resistance (mΩ) | Surface hardness (HV) | Salt spray test 1 H | 24 H | 168 H | whiskers |
|---|---|---|---|---|---|---|---|---|---|---|
| Example 2 (Sn + 0.3% Gd) | Iron-based substrate | 2.0 | ◎ | ○ | 0.295 | 39.2 | ○ | ○ | ○ | Slightly generated |
| | Copper-based substrate | 2.0 | ◎ | ○ | 0.287 | 39.2 | ○ | ○ | ○ | Generated |
| Example 3 (Sn + 8% Gd) | Iron-based substrate | 2.0 | ◎ | ○ | 0.345 | 94.3 | ○ | ○ | ○ | Not generate |
| | Copper-based substrate | 2.0 | ◎ | ○ | 0.326 | 94.3 | ○ | ○ | ○ | Not generate |
| Example 4 (Sn + 54% Gd) | Iron-based substrate | 2.0 | ◎ | ○ | 0.348 | 163 | ○ | ○ | ○ | Not generated |
| | Copper-based substrate | 2.0 | ◎ | ○ | 0.329 | 163 | ○ | ○ | ○ | Not generated |
| Comparative Example 1 (Sn − 10% Pb) | Iron-based substrate | 2.0 | X | ○ | 0.302 | 11.1 | ○ | ○ | ○ | Not generated |
| | Copper-based substrate | 2.0 | X | ○ | 0.276 | 11.1 | ○ | ○ | ○ | Not generated |
| Comparative Example 2 (Sn + 0.01% Gd) | Iron-based substrate | 2.0 | X | ○ | 0.227 | 12.3 | ○ | ○ | X | Generated |
| | Copper-based substrate | 2.0 | X | ○ | 0.211 | 12.3 | ○ | ○ | X | Generated |
| Comparative Example 3 (Tin Sulfate) | Iron-based substrate | 2.0 | X | ○ | 0.478 | 11.3 | ○ | ○ | X | Generated |
| | Copper-based substrate | 2.0 | X | ○ | 0.444 | 11.3 | ○ | ○ | X | Generated |
| Comparative Example 4 (Tin organic acid) | Iron-based substrate | 2.0 | X | ○ | 0.248 | 12.9 | X | X | X | Generated |
| | Copper-based substrate | 2.0 | X | ○ | 0.217 | 12.9 | X | X | X | Generated |
| Comparative Example 5 (Sn − 2% Ag) | Iron-based substrate | 2.0 | X | ○ | 0.302 | 12.3 | ○ | X | X | Generated |
| | Copper-based substrate | 2.0 | X | ○ | 0.275 | 12.3 | ○ | X | X | Generated |

Heat-resistance test:
◎ Good
○ Rather good
X Discolored
Cross-cut:
○ Good
X Separation appeared
Salt spray test:
○ Good
X Corrosion appeared
Whisker test:
Slightly generated (1 to 10 micrometers), Generated (10 micrometers or longer)

In all the Comparative Examples including tin-lead alloy plating (Comparative Example 1), there was observed discoloration after the heat-resistance test. On the other hand, Examples 1 to 4 according to the present invention generated no discoloration and separation, thus confirmed to have sufficient heat resistance. In the salt spray test, there was observed corrosion on the 0.01% gadolinium-containing tin plating film (Comparative Example 2), the plating film composed only of tin (Comparative Examples 3 and 4), and the tin-silver alloy plating film (Comparative Example 5). To the contrary, the plating film (Examples 1 to 4) according to the present invention and the tin-lead alloy plating film (Comparative Example 1) generated no corrosion even after 8 hours.

Furthermore, the plating film according to the present invention confirmed to have higher surface hardness than that of the tin-lead alloy plating, while keeping a surface contact resistance similar to that of the tin-lead alloy plating.

According to the observation of generation of whiskers after high temperature and high humidity test, a tendency of suppressing the generation of whiskers appeared on the iron-based base material in the case of 0.1% of gadolinium (Example 1) and of 0.3% thereof (Example 2). In addition, Examples 3 and 4 showed no generation of whiskers for both the iron-based base material and copper-based base material. On the other hand, all the Comparative Examples generated whiskers except for the tin-lead alloy plating (Comparative Example 1).

Next, the solder wettability test was given to the plating films obtained from the respective plating baths of Examples 1 to 4 and of Comparative Examples 1 to 5 shown in Table 5. The result is given in Table 6.

TABLE 6

| Bath | Substrate | Sn—Pb eutectoid Maximum wetting force Fmax mN | End wetting force Fend mN | Zero cross time T0 sec | Wetting force time T1 sec | Stability Sb % | Sn—Ag—Cu Maximum wetting force Fmax mN | End wetting force Fend mN | Zero cross time T0 sec | Wetting force time T1 sec | Stability Sb % |
|---|---|---|---|---|---|---|---|---|---|---|---|
| Example 1 (Sn + 0.1% Gd) | Iron-based substrate | 3.164 | 3.164 | 0.36 | 0.62 | 100 | 3.072 | 3.072 | 057 | 0.72 | 100 |
| | Copper-based substrate | 3.154 | 3.154 | 0.35 | 0.60 | 100 | 3.064 | 3.064 | 0.56 | 0.70 | 100 |
| Example 2 (Sn + 0.3% Gd) | Iron-based substrate | 3.122 | 3.122 | 0.36 | 0.62 | 100 | 3.004 | 3.004 | 0.57 | 0.75 | 100 |
| | Copper-based substrate | 3.103 | 3.103 | 0.36 | 0.61 | 100 | 3.011 | 3.011 | 0.57 | 0.73 | 100 |
| Example 3 (Sn + 8% Gd) | Iron-based substrate | 3.039 | 3.039 | 0.38 | 0.64 | 100 | 2.974 | 2.974 | 0.61 | 0.78 | 100 |
| | Copper-based substrate | 3.016 | 3.016 | 0.36 | 0.62 | 100 | 2.961 | 2.961 | 0.60 | 0.77 | 100 |
| Example 4 (Sn + 54% Gd) | Iron-based substrate | 2.976 | 2.976 | 0.37 | 0.66 | 100 | 2.722 | 2.722 | 0.62 | 0.86 | 100 |
| | Copper-based substrate | 2.968 | 2.368 | 0.37 | 0.64 | 100 | 2.704 | 2.704 | 0.61 | 0.84 | 100 |
| Comparative Example 1 (Sn − 10% Pb) | Iron-based substrate | 3.171 | 3.171 | 0.35 | 0.61 | 100 | 3.016 | 3.016 | 0.59 | 0.76 | 100 |
| | Copper-based substrate | 3.174 | 3.174 | 0.34 | 0.61 | 100 | 3.020 | 3.020 | 0.58 | 0.77 | 100 |
| Comparative Example 2 (Sn + 0.01% Gd) | Iron-based substrate | 3.174 | 3.174 | 0.34 | 0.59 | 100 | 3.120 | 3.120 | 0.60 | 0.79 | 100 |
| | Copper-based substrate | 3.170 | 3.170 | 0.33 | 0.57 | 100 | 3.119 | 3.119 | 0.60 | 0.79 | 100 |
| Comparative Example 3 (Tin Sulfate) | Iron-based substrate | 3.184 | 3.184 | 0.34 | 0.60 | 100 | 3.127 | 3.127 | 0.59 | 0.78 | 100 |
| | Copper-based substrate | 3.179 | 3.179 | 0.34 | 0.59 | 100 | 3.122 | 3.122 | 0.59 | 0.78 | 100 |
| Comparative Example 4 (Tin organic acid) | Iron-based substrate | 3.176 | 3.176 | 0.33 | 0.55 | 100 | 3.120 | 3.120 | 0.59 | 0.80 | 100 |
| | Copper-based substrate | 3.170 | 3.170 | 0.32 | 0.53 | 100 | 3.116 | 3.116 | 0.59 | 0.76 | 100 |
| Comparative Example 5 (Sn − 2% Ag) | Iron-based substrate | 3.063 | 3.063 | 0.36 | 0.59 | 100 | 2.987 | 2.987 | 0.60 | 0.80 | 100 |
| | Copper-based substrate | 3.047 | 3.047 | 0.36 | 0.58 | 100 | 2.990 | 2.990 | 0.59 | 0.78 | 100 |

*Sn—Pb eutectoid = 60%-40%

*Sn—Ag—Cu = 96.5%-3%-0.5% (M705, manufactured by Senju Metal Industry Co., Ltd.)

*Tin-Silver-Copper = 96.5% - 3% - 0.5% (with M705 product manufactured by Senju Metal Industry Co., Ltd.)

As shown in Table 6, Examples 1 to 4 according to the present invention showed to have wettability similar to that of the tin-lead alloy plating (Comparative Example 1) for both the lead-based solder (tin-lead eutectoid solder) and the lead-free solder (tin-silver-copper solder).

The invention claimed is:

1. A substrate comprising an electroplating deposited on a surface thereof, the electroplating containing:

(1) tin by a quantity of 99.9% by mass to 46% by mass based on entire metal mass; and (2) gadolinium by a quantity of 0.1% by mass to 54% by mass based on entire mass.

2. The substrate according to claim 1, wherein said substrate is in an electronic member or an electric member.

3. An electroplating method to deposit a tin-containing alloy on a surface of a substrate, comprising the steps of:

immersing the substrate in a plating bath; and applying an electric field to the substrate, and said plating bath containing:

(a) a tin compound containing 99.9% by mass to 46% by mass of tin based on entire metal mass in the plating bath;

(b) a gadolinium compound containing 0.1% by mass to 54% by mass of gadolinium based on entire metal mass in the plating bath;

(c) at least one complexing agent; and (d) a solvent.

4. An electroplating bath to deposit a tin-containing alloy on a surface of a substrate, comprising:

(a) a tin compound containing 99.9% by mass to 46% by mass of tin based on entire metal mass in the plating bath;

(b) a gadolinium compound containing 0.1% by mass to 54% by mass of gadolinium based on entire metal mass in the plating bath;

(c) at least one complexing agent; and (d) a solvent.

* * * * *